US009091060B2

(12) United States Patent
Kuras

(10) Patent No.: US 9,091,060 B2
(45) Date of Patent: Jul. 28, 2015

(54) SOUND PANEL AND METHOD FOR ASSEMBLY OF A SOUND PANEL

(71) Applicant: Glenn Kuras, Atlanta, GA (US)

(72) Inventor: Glenn Kuras, Atlanta, GA (US)

( * ) Notice: Subject to any disclaimer, the term of this patent is extended or adjusted under 35 U.S.C. 154(b) by 0 days.

(21) Appl. No.: 14/050,046

(22) Filed: Oct. 9, 2013

(65) Prior Publication Data

US 2015/0096831 A1 Apr. 9, 2015

(51) Int. Cl.
*E04B 1/86* (2006.01)
*E04B 1/84* (2006.01)

(52) U.S. Cl.
CPC ..... *E04B 1/84* (2013.01)

(58) Field of Classification Search
CPC ..... E04B 1/86
USPC ..... 181/290, 284
See application file for complete search history.

(56) References Cited

U.S. PATENT DOCUMENTS

| | | | | |
|---|---|---|---|---|
| 4,084,367 | A * | 4/1978 | Saylor et al. | 428/113 |
| 6,158,176 | A * | 12/2000 | Perdue | 52/144 |
| 6,196,352 | B1 * | 3/2001 | Goodchild | 181/290 |
| 6,321,871 | B1 * | 11/2001 | Russell | 181/295 |
| 7,063,184 | B1 | 6/2006 | Johnson | |
| 8,087,494 | B2 * | 1/2012 | Palumbo et al. | 181/290 |
| 8,739,924 | B2 * | 6/2014 | Johnson | 181/290 |
| 2006/0157297 | A1 | 7/2006 | D'Antonio | |
| 2008/0073146 | A1 * | 3/2008 | Thompson et al. | 181/291 |

OTHER PUBLICATIONS

Kuras, Glenn; European Search Report for application No. 14188292.8, filed Oct. 9, 2014, mailed Feb. 19, 2015, 7 pgs.

* cited by examiner

*Primary Examiner* — Forrest M Phillips
(74) *Attorney, Agent, or Firm* — Taylor English Duma LLP

(57) ABSTRACT

A sound panel includes an outer fabric, an absorption member that at least indirectly connects to the outer fabric, and a frame that is at least indirectly connected to the absorption member, where the outer fabric is fastened to the frame.

20 Claims, 6 Drawing Sheets

SOUND PANEL AND METHOD FOR ASSEMBLY OF A SOUND PANEL

TECHNICAL FIELD AND BACKGROUND

This disclosure relates to sound panels, for example, acoustic panels and bass traps. Sound panels are acoustic energy absorbers which are designed to dampen different frequencies of sound energy with the goal of attaining a certain level and range of different frequencies within a room or area. The sound panels function by turning sound energy into heat through friction.

SUMMARY

Disclosed is a sound panel including at least an outer fabric, an absorption member at least indirectly connected to the outer fabric, and a frame at least indirectly connected to the absorption member, wherein the outer fabric is fastened to the frame.

Also disclosed is a method for constructing a sound panel including at least obtaining an outer fabric, placing an absorption member on the outer fabric, placing a frame on the absorption member, and fastening the outer fabric to the frame.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Within this application a sound panel and associated methods, systems, devices, and various apparatus are disclosed. The sound panel includes at least outer fabric, one absorption member, and one frame. It would be understood by one of skill in the art that the disclosed sound panel is described in but a few exemplary embodiments among many. No particular terminology or description should be considered limiting on the disclosure or the scope of any claims issuing therefrom.

Figure 11:
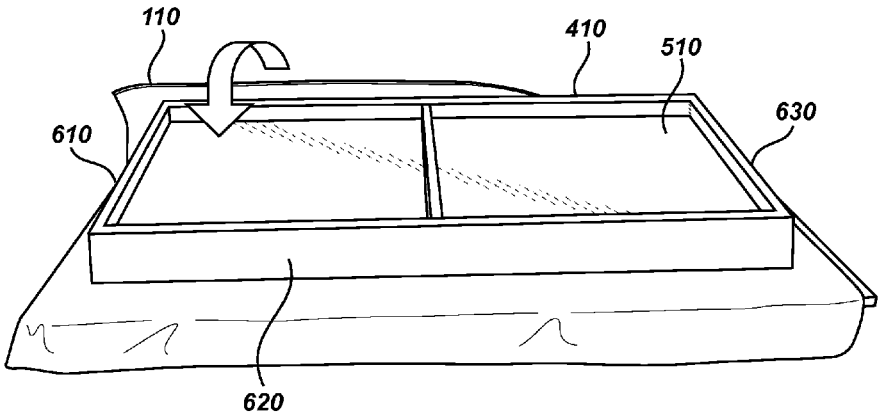
FIG. 11 is a perspective view of the assembly of FIG. 10 with the fabric material being wrapped around the frame of the assembly of FIG. 10.
Figure 12:
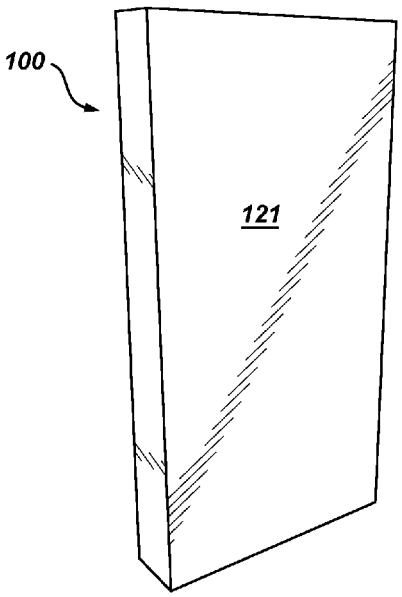
FIG. 12 is a perspective view of the top side of a sound panel in accord with one embodiment of the current disclosure.
Figure 13:
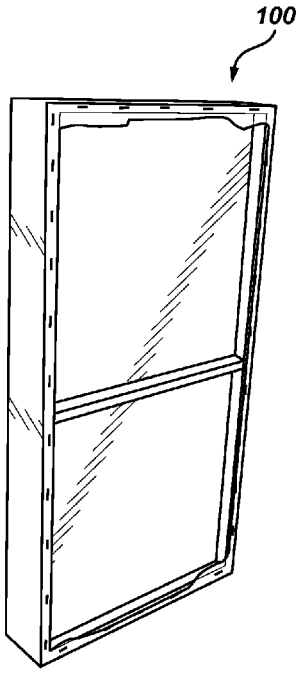
FIG. 13 is a perspective view of the bottom side of a sound panel in accord with the embodiment shown in FIG. 12.

One embodiment of a sound panel 100 is disclosed and described in FIGS. 12-13. In order to construct the sound panel 100, a multitude of methods may be used. In the current embodiment, one method of construction is illustrated in FIGS. 1-11.

Figure 1:
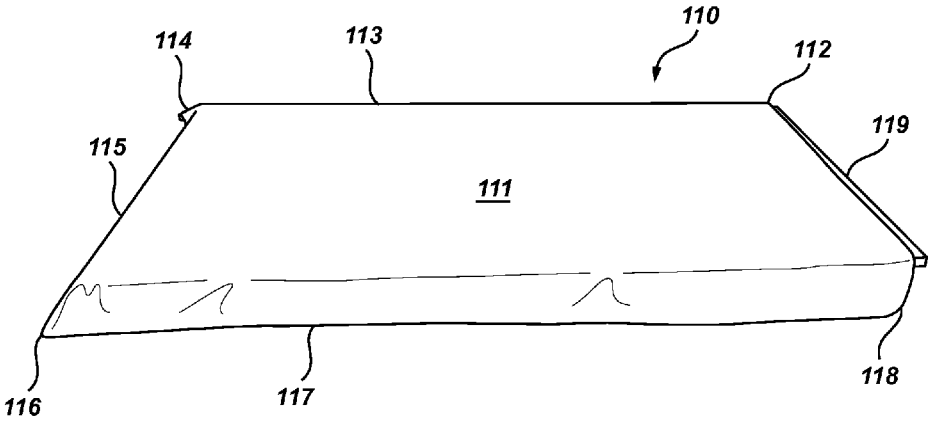
FIG. 1 is a perspective view of fabric laid out on a flat surface in accord with one embodiment of the current disclosure.

FIG. 1 shows outer fabric 110 placed on a flat surface; however, the outer fabric 100 is not required to be initially placed on a flat surface. As seen in FIG. 1, the outer fabric 110 includes a back end 113, a front end 117, a top surface 111, and a bottom surface 121 (not shown). Also, the outer fabric 110 includes a left end 115, a right end 119, and corners 112, 114, 116, and 118. Directional references such as "up," "down," "top," "left," "right," "front," "back," and "corners," among others are intended to refer to the orientation as shown and described in figure (or figures) the components and directions are referencing. The shape of the outer fabric 110 is not required to be rectangular, and can be any other shape, such as a triangle, diamond, polygon, circle, among others. In the current embodiment, the outer fabric 110 is made of thin breathable fabric, but other materials and types of fabrics may be used. Moreover, in alternative embodiments, outer fabric 110 is not required.

Figure 2:
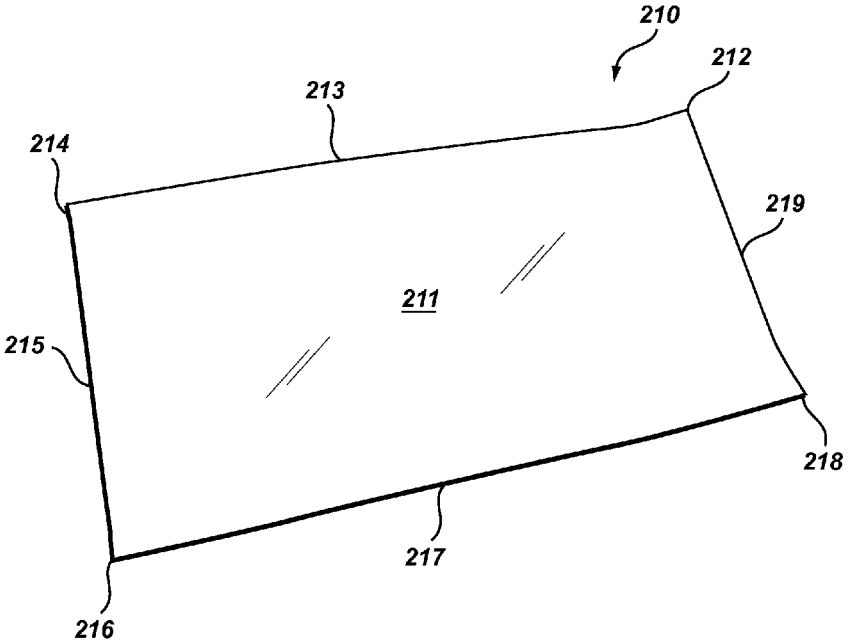
FIG. 2 is a perspective view of a membrane in accord with one embedment of the current disclosure.

FIG. 2 shows membrane 210 from a perspective view. In the current embodiment, the membrane 210 includes a back end 213, a front end 217, a top surface 211, and a bottom surface 221 (not shown). Also, the membrane 210 includes a left end 215, a right end 219, and corners 212, 214, 216, and 218. The shape of the membrane 210 is not required to be rectangular, and can be any other shape, such as a triangle, diamond, polygon, circle, among others. In the current embodiment, the membrane 210 is made of 0.5 pounds of mass loaded vinyl, but any type of flexible material and different weights of such material, may be used. Moreover, in alternative embodiments, membrane 210 is not required. The membrane 210 limits frequencies over 400 hz. Without the membrane 210, there would be a broader frequency absorption than with the use of the absorption member 310 alone.

Figure 3:
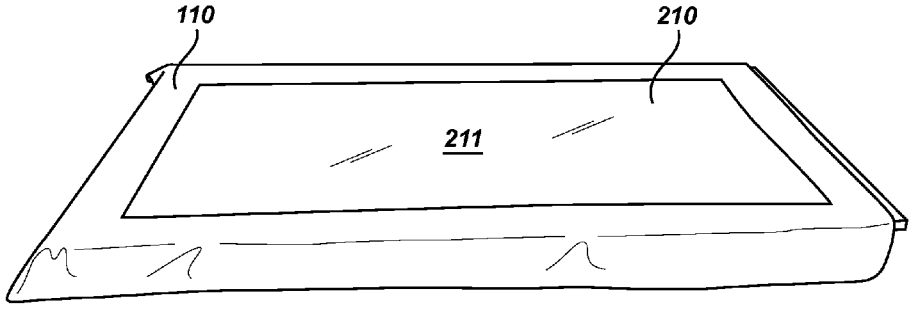
FIG. 3 is a perspective view of the membrane of FIG. 2 placed on top of the fabric of FIG. 1.

FIG. 3 displays the bottom surface 221 of the membrane 210 being placed on the top surface 111 of the outer fabric 110. In the current embodiment, the top surface 211 of the membrane 210 faces upward, and the membrane 210 is placed in the middle of the outer fabric 110; however, such a configuration is not required. Additionally, in FIG. 3, the size, or distances from the back end 213 to the front end 217 and the left end 215 to the right end 219 of the membrane are shorter than the distances from the back end 113 to the front end 117 and the left end 115 to the right end 119 of the outer fabric 110. However, such a configuration is not required and the membrane 210 may be larger than or equal in size to the outer fabric 110.

Figure 4:
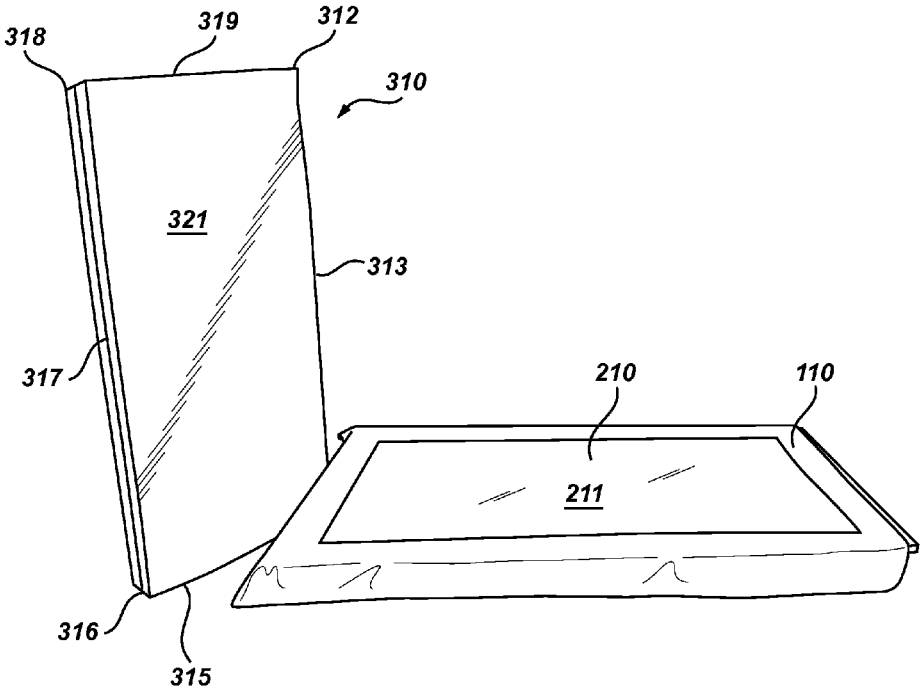
FIG. 4 is a perspective view of an absorption member next to assembly of FIG. 3.

In FIG. 4, an absorption member 310 is provided. In the current embodiment, the absorption member 310 includes a back end 313, a front end 317, a top surface 311 (not shown), and a bottom surface 321. Also, the absorption member 310 includes a left end 315, a right end 319, and corners 312, 314, 316, and 318. The distances from the back end 313 to the front end 317 and the left end 315 to the right end 319 of the absorption member are approximately equal to the distances from the back end 213 to the front end 217 and the left end 215 to the right end 219 of the membrane 210. However, such a configuration is not required and the absorption member 310 may be different in size to the membrane 210. The shape of the absorption member 310 is not required to be rectangular, and can be any other shape, such as a triangle, diamond, polygon, circle, among others. In the current embodiment, the absorption member 310 is made of fiberglass, but other materials may be used. In the current embodiment, the fiberglass is four inches thick, and the density is 1.6 lbs./cubic foot. However, the thickness and density of the absorption member 310 can be varied and adjusted to capture different ranges of frequencies. In alternative embodiments, the thickness of the absorption member 310 may include a range of thicknesses, such as two inches, four inches, or six inches, among other. In one aspect, the thickness is from 2 to 24 inch thick fiberglass. Likewise, in alternative embodiments the density of the absorption member 310 may include a range of densities, such as 0.5 lbs./cubic foot, 1 lbs./cubic foot, 3 lbs./cubic foot, or 6 lbs./cubic foot, among others. In one aspect, the absorption member is constructed from about 1.6 lbs./cubic foot to 10 lbs./cubic foot density. It is well understood in the industry that when thicker absorption members 310 are used, the range of frequencies that are captured increases. Also, in the current embodiment, the thickness of the absorption member 310 may be adjusted before or after assembly is complete.

Figure 5:
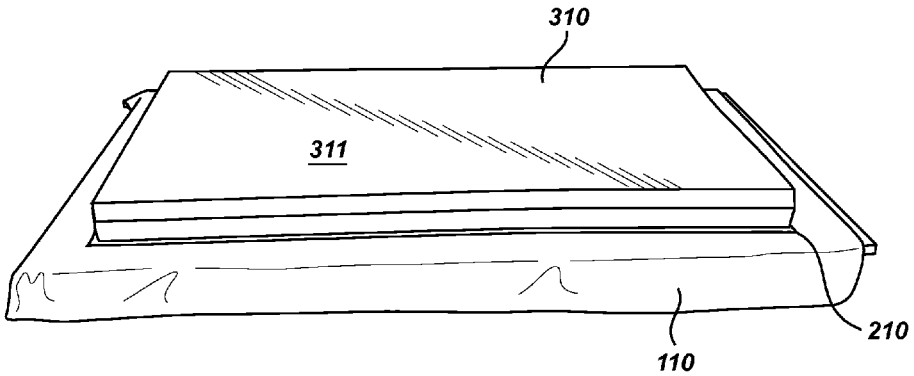
FIG. 5 is a perspective view of the absorption member placed on top of the assembly of FIG. 3.

FIG. 5 displays the bottom surface 321 of the absorption member 310 placed on the top surface 211 of the membrane 210. In the current embodiment, the top surface 311 of the absorption member 310 faces upward, and both the membrane 210 and absorption member 310 are placed in the middle of the outer fabric 110; however, such a configuration is not required. Additionally, in FIG. 3, the distances from the back end 313 to the front end 317 and the left end 315 to the right end 319 of the absorption member 310 are shorter than the distances from the back end 113 to the front end 117 and the left end 115 to the right end 119 of the outer fabric 110. However, such a configuration is not required and the absorption member 310 may be larger than or equal in size to the outer fabric 110.

Figure 6:
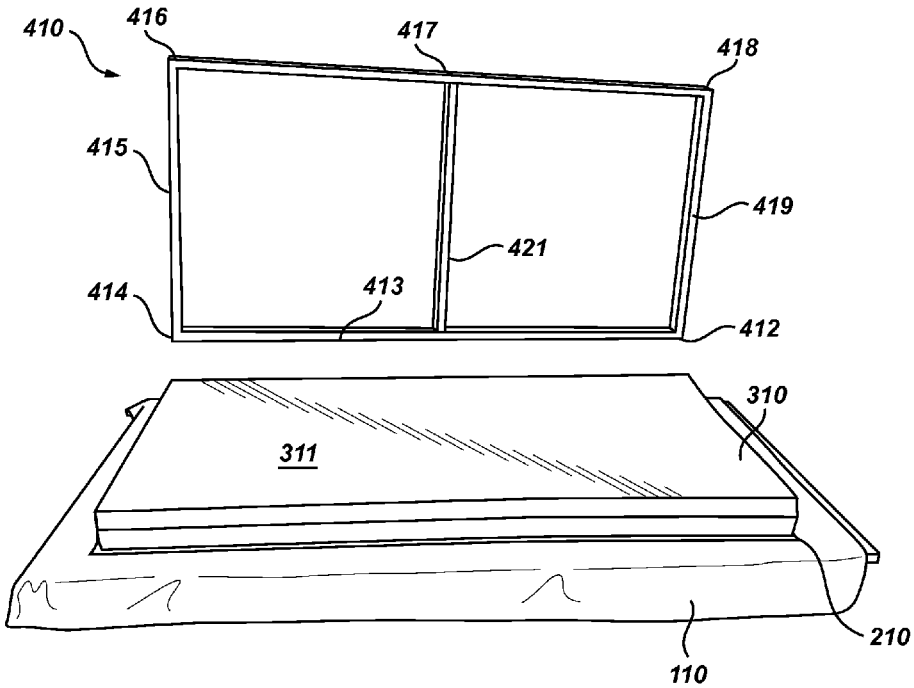
FIG. 6 is a bottom view of a frame next to the assembly of FIG. 5.

In FIG. 6 a frame 410 is provided. In the current embodiment, the frame 410 includes a back end 413, a front end 417, a top surface 411 (not shown), and a bottom surface 421. Also, the frame 410 includes a left end 415, a right end 419, and corners 412, 414, 416, and 418. The shape of the frame 410 in the current embodiment is a rectangle with sectional strip of wood (the component where the bottom surface 421 is indicated—although the bottom surface 421 includes the entire bottom surface of all of the peripheral components of the frame 410 (412, 413, 414, 415, 416, 417, 418, and 419)). The frame 410 is not required to include the sectional strip of wood, nor is the frame 410 required be rectangular, and any other shape, such as a triangle, diamond, polygon, circle, among others, may be used. An advantage that the frame 410 contributes is to providing a built-in air gap to the sound panel 100, thereby enhancing the performance of the sound panel 100. In the current embodiment, the frame 410 is made of thin wood; however, other materials and thicknesses of materials may be used. Additionally, in other embodiments, frame 410 may not be required. The peripheral components of the frame 410 (412, 413, 414, 415, 416, 417, 418, and 419)) also let in lower frequencies.

Figure 7:
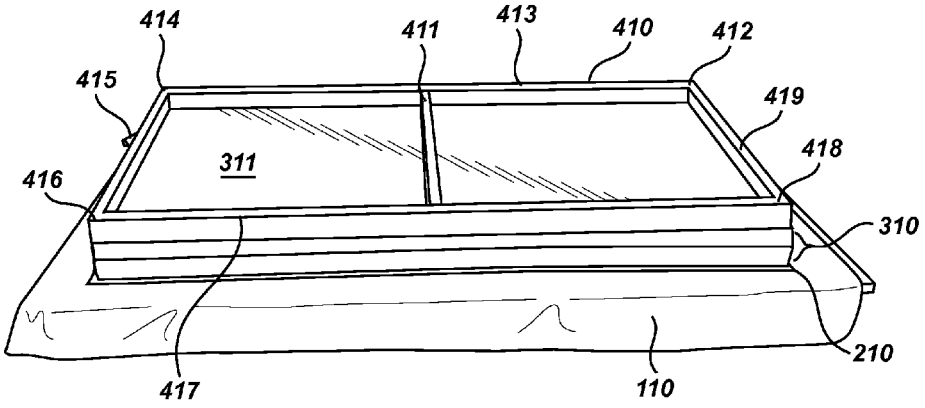
FIG. 7 is a perspective view of the frame of FIG. 6 placed on top of the assembly of FIG. 7

FIG. 7 shows the bottom surface 421 of frame 410 placed on the top surface 311 of the absorption member 310. In the current embodiment, the top surface 311 of the absorption member 310 faces upward, and the membrane 210, absorption member 310, and frame 410 are placed in the middle of the outer fabric 110; however, such a configuration is not required. In this embodiment, the size, or the distances from the back end 413 to the front end 417 and the left end 415 to the right end 419 of the frame 410 are approximately equal to the size, or distances from the back end 313 to the front end 317 and the left end 315 to the right end 319 of the absorption member 310. However, such a configuration is not required and the frame 410 may be different in size to the absorption member 310. The sound panel 100 may be placed between a wall or other divider. In other aspects the sound panel 100 may be affixed to a wall or divider in a permanent manner or non-permanent manner. The sound panel 100 may be placed in a manner where there is space between the the sound panel 100 and the wall or devider. Ultimately, the space between the absorption member 310 and the surface of the wall or devider will affect, and usually increase, low end performance.

Figure 8:
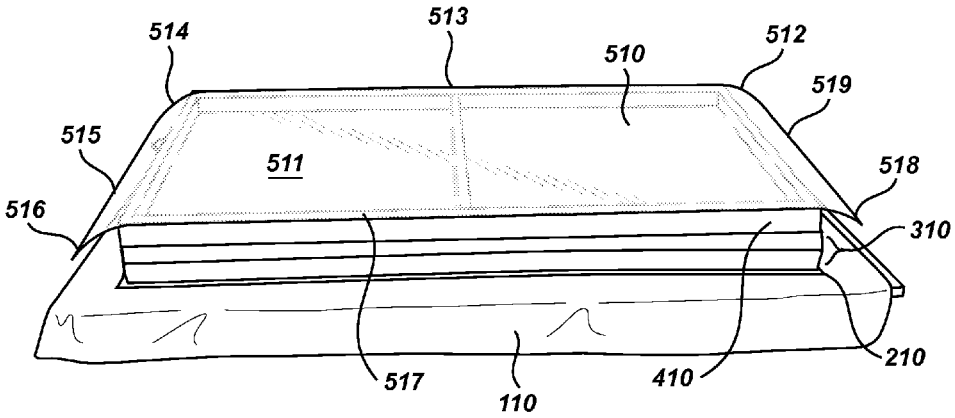
FIG. 8 is a perspective view of FIG. 7 that also includes fabric overlaying the frame.

As shown in FIG. 8, inner fabric 510 is placed over frame 410. In the current embodiment, the inner fabric 510 includes a back end 513, a front end 517, a top surface 511, and a bottom surface 521 (not shown). Also, the inner fabric 510 includes a left end 515, a right end 519, and corners 512, 514, 516, and 518. In the current embodiment, the inner fabric 510 is made to be approximately the same size as the frame 410 and is fastened to the frame 410. The inner fabric 510 may be fastened to the frame 410 by the use of staples, nails, screws, ties, glue, or clips, among other fasteners. However, the inner fabric 510 is not required to be the same size as the frame 410 nor is it required to be the same shape. Additionally, the inner fabric 510 does not have to be fastened to the frame. In the current embodiment, the inner frame is made of muslin fabric; however, other materials and types of fabrics may be used. Moreover, in alternative embodiments, the inner fabric 510 is not required. The inner fabric 510 provides a density function for lower frequencies.

Figure 9:
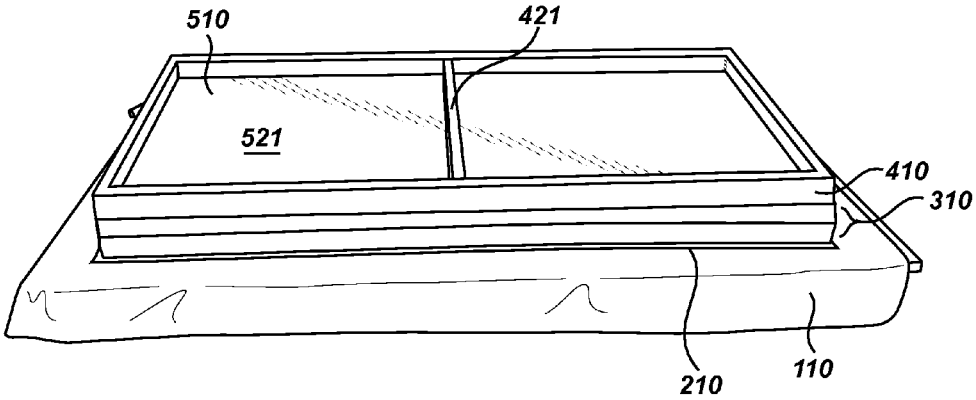
FIG. 9 is a perspective view of the assembly of FIG. 8 with the frame inverted from the position of the frame in FIG. 8.

FIG. 9 shows that the frame 410 and inner fabric 510 unit has been inverted on the absorption member 310. In FIG. 9 it is shown that the top surfaces 411 and 511 of the frame 410 and inner fabric 510, respectively, are now facing the top surface 311 of the absorption member 310, as opposed to the configuration in FIG. 8.

Figure 10:
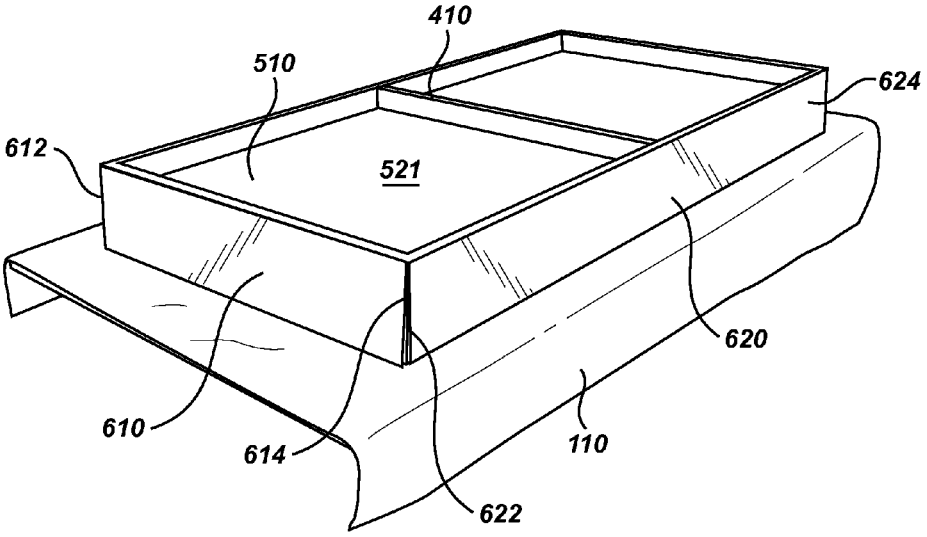
FIG. 10 is a side perspective view of the assembly of FIG. 9 on fabric material with boards fastened around the exterior portions of the assembly of FIG. 9.

In FIG. 10, boards 610, 620, 630 (not shown), and 640 (not shown) are fastened to the exterior frame, which includes the outer portions of back ends (213, 313, 413, and 513), front ends (217, 317, 417, and 517), left ends (215, 315, 415, and 515), right ends (219, 319, 419, and 519), and corners (212, 214, 216, 218, 312, 314, 316, 318, 412, 414, 416, 418, 512, 514, 516, and 518). However, boards 610, 620, 630 (not shown), and 640 (not shown) are not required to cover or be fastened to all of the exterior frame (previously described). In the current embodiment, the boards 610, 620, 630 (not shown), and 640 (not shown) are made to be approximately the same height as the combination of the membrane 210, absorption member 310, frame 410, and inner fabric 510. A specific height is not required and other heights may be used. Additionally, the boards 610, 620, 630 (not shown), and 640 (not shown) are fastened to the exterior frame (previously described), which may be done by the use of staples, nails, screws, glue, ties, or clips, among other fasteners. The boards 610, 620, 630 (not shown), and 640 (not shown) lets in lower frequencies. However, boards 610, 620, 630 (not shown), and 640 (not shown) do not have to be fastened to the exterior frame (previously described). In the current embodiment, the boards 610, 620, 630 (not shown), and 640 (not shown) are made of fiberboard that is 1/16 inch thick; however, other materials and thicknesses may be used. Moreover, in alternative embodiments, the boards 610, 620, 630 (not shown), and 640 (not shown) are not required.

In FIG. 11, it is shown that portions of the outer fabric 110 are folded upon the sides of the combination of the membrane 210, absorption member 310, frame 410, inner fabric 510, and boards 610, 620, 630 (not shown), and 640 (not shown). In the current embodiment, the back end 113 is folded upon the back ends 213, 313, 413, 513, and board 640 (not shown), the front end 117 is folded upon the front ends 217, 317, 417, 517, and board 620, the left end 115 is folded upon the left ends 215, 315, 415, 515, and board 610, the right end 119 is folded upon the right ends 219, 319, 419, 519, and board 630 (not shown), and the corners 112, 114, 116, and 118 are folded upon their respective corners 212, 214, 216, 218, 312, 314, 316, 318, 412, 414, 416, 418, 512, 514, 516, and 518. After the portions of the outer fabric 110, described above, are folded upon the sides (as described above), the portions of the outer fabric 110 are fastened to the combined sides (previously described), which may be done by the use of staples, nails, screws, glue, ties, or clips, among other fasteners. However, the portions of the outer fabric 110 do not have to be fastened to the combined sides (previously described), and in alternative embodiments, the outer fabric 110 may not be folded upon the combined sides (previously described).

FIGS. 12 and 13 show a constructed sound panel 100, in the current embodiment, from different perspective views.

As previously mentioned, one possible method of construction for sound panel 100 is shown in FIGS. 1-11. However, such a method of construction is not required, as some elements are not required and the order of operations may be modified and adjusted. By way of example, FIG. 1 shows the outer fabric 110 placed on a flat surface to begin construction. Next, as shown in FIGS. 2-3, membrane 210 is placed on the top surface 111 of the outer fabric 110. Absorption member 310 may then be placed on the top surface 211 of membrane 210, as shown in FIGS. 4-5. As shown in FIGS. 6-7, frame 410 is placed on the top surface 311 of the absorption member 310, so the bottom surface 421 of frame 410 is facing the top surface 311. In FIG. 8, inner fabric 510 is placed and fastened on the top surface 411 of the frame 410. Next, as shown in FIG. 9, the frame 410 is inverted with respect to the absorption member 310; as such, top surface 411 of frame 410 is facing the top surface 311 of absorption member 310. In FIG. 10, boards 610, 620, 630 (not shown), and 640 (not shown) are placed and fastened on the exterior frame (as previously described). Finally, as shown in FIG. 11, portions of the outer fabric 110 are folded upon and fastened to the combined sides (previously described). Once the steps of FIGS. 1-11 are completed, the sound panel 100, of the current embodiment, as shown FIGS. 12 and 13, is constructed.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and subcombinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A sound panel comprising:

an outer fabric;

an absorption member having a top surface and a bottom surface, wherein the bottom surface of the absorption member is at least indirectly connected to the outer fabric; and a frame having a top surface and a bottom surface, wherein the bottom surface of the frame is at least indirectly connected to and facing the top surface of the absorption member, and wherein the outer fabric is fastened to the frame.

2. The sound panel of claim 1, further comprising a membrane placed between the outer fabric and the absorption member.

3. The sound panel of claim 1, further comprising an inner fabric fastened to the frame.

4. The sound panel of claim 1, further comprising a plurality of boards fastened to an exterior frame of the sound panel.

5. The sound panel of claim 2, further comprising an inner fabric fastened to the frame.

6. The sound panel of claim 2, further comprising a plurality of boards fastened to an exterior frame of the sound panel.

7. The sound panel of claim 3, further comprising boards fastened to an exterior frame of the sound panel.

8. The sound panel of claim 1, further comprising:

a membrane placed between the outer fabric and the absorption member;

an inner fabric fastened to the frame; and boards fastened to an exterior frame of the sound panel.

9. The sound panel of claim 1, wherein the absorption member is constructed from about 1.6 lbs./cubic foot to 10 lbs./cubic foot density and from 2 to 24 inch thick fiberglass.

10. The sound panel of claim 1, wherein the absorption member is constructed with about 1.6 lbs./cubic foot density and 4 inch thick fiberglass.

11. The sound panel of claim 1, wherein the outer fabric is fastened to the frame by a plurality of nails.

12. A method of constructing a sound panel, comprising:

obtaining an outer fabric;

placing an absorption member on the outer fabric;

placing a frame on a top surface of the absorption member, wherein a bottom surface of the frame faces the top surface of the absorption member; and fastening the outer fabric to the frame.

13. The method of claim 12, further comprising placing a membrane between the outer fabric and the absorption member.

14. The method of claim 13, further comprising fastening an inner fabric to the frame.

15. The method of claim 13, further comprising fastening a plurality of boards to an exterior frame of the sound panel.

16. The method of claim 12, further comprising:

placing a membrane between the outer fabric and the absorption member;

fastening an inner fabric to the frame; and fastening a plurality of boards to an exterior frame of the sound panel.

17. The method of claim 16, wherein the absorption member is constructed with 1.6 lbs./cubic foot density and 4 inch thick fiberglass, the membrane, absorption member, and frame are rectangular in shape, and the frame is inverted after the inner fabric is fastened to the frame.

18. The method of claim 16, wherein the absorption member is constructed with 1.6 lbs./cubic foot density and 4 inch thick fiberglass, the membrane, absorption member, and frame are rectangular in shape, and the frame is inverted after the inner fabric is fastened to the frame.

19. The method of claim 17, wherein the membrane, the absorption member, and the frame are different shapes from one another.

20. The sound panel of claim 1, wherein the absorption member and the frame are rectangular in shape.

* * * * *